US006857339B2

(12) United States Patent
Chen

(10) Patent No.: US 6,857,339 B2
(45) Date of Patent: Feb. 22, 2005

(54) WRENCH STRUCTURE

(76) Inventor: Terence Chen, No. 325, Yungching Rd., Dungshan Shiang, Ilan (TW)

( * ) Notice: Subject to any disclaimer, the term of this patent is extended or adjusted under 35 U.S.C. 154(b) by 51 days.

(21) Appl. No.: 10/428,114

(22) Filed: May 2, 2003

(65) Prior Publication Data

US 2004/0200321 A1 Oct. 14, 2004

(30) Foreign Application Priority Data

Apr. 14, 2003 (TW) ..... 92205935 U

(51) Int. Cl.[7] ..... B25B 13/46

(52) U.S. Cl. ..... 81/63.1; 81/58; 81/60; 192/43.1

(58) Field of Search ..... 81/58, 58.4, 60–62, 81/63.1, 65.1; 192/43.1

(56) References Cited

U.S. PATENT DOCUMENTS 3,436,992 A * 4/1969 Over et al. ..... 81/63.1
6,279,428 B1 * 8/2001 Huang ..... 81/63.1
6,516,930 B2 * 2/2003 Chen ..... 192/43.2
6,575,060 B1 * 6/2003 Tseng et al. ..... 81/63.2
6,691,594 B2 * 2/2004 Chen ..... 81/61

* cited by examiner

*Primary Examiner*—David B. Thomas
(74) *Attorney, Agent, or Firm*—Rosenberg, Klein & Lee

(57) ABSTRACT

A wrench structure includes a drive head formed with a receiving chamber and having an end face formed with a direction control recess. The end face of the drive head is formed with a spacing portion. Thus, the spacing portion is continuously extended through the end face of the drive head and is not broken, so that the end face of the drive head is continuously extended through the drive head and is not broken, thereby preventing the stress from being concentrated on the portion between the receiving chamber and the direction control recess of the drive head, such that the structural strength of the drive head can be enhanced.

1 Claim, 6 Drawing Sheets

WRENCH STRUCTURE

BACKGROUND OF THE INVENTION

1. Field of the Invention

The present invention relates to a wrench structure, and more particularly to a wrench structure provided with a continuously arranged spacing portion located between the receiving chamber and the direction control recess to enhance the structural strength of the wrench structure.

2. Description of the Related Art

A conventional wrench comprises a wrench body, a drive device, two locking blocks, and a control disk. The wrench body has a central through hole having a receiving recess and a locking recess communicating with each other. The drive device is mounted in the central through hole of the wrench body. Each of the two locking blocks is mounted in the receiving recess of the wrench body and is engaged with the drive device. A spring is mounted between the two locking blocks. Each of the two locking blocks has a locking stub. The control disk is mounted in the locking recess of the wrench body, and is formed with a driving hole for driving the locking stub of one of the two locking blocks. Thus, the control disk may be rotated to pivot one of the two locking blocks to mesh with the drive device.

However, the conventional wrench has the following disadvantages.

1. The wrench body is divided by the central through hole, the receiving recess and the locking recess, so that the surface of the wrench body is disposed at a broken state, and the stress is easily concentrated on the surface of the wrench body, thereby decreasing the structural strength of the wrench.

2. The locking stub of each of the two locking blocks is controlled by the driving hole of the control disk. The driving hole of the control disk cannot retain the locking stub of each of the two locking blocks efficiently, so that each of the two locking blocks cannot be moved be lock the drive device exactly, thereby affecting efficiency of operation of the conventional wrench.

SUMMARY OF THE INVENTION

The present invention has arisen to mitigate and/or obviate the disadvantage of the conventional wrench.

The primary objective of the present invention is to provide a wrench structure that is provided with a continuously arranged spacing portion located between the receiving chamber and the direction control recess, for enhancing the structural strength of the wrench handle of the wrench structure.

Another objective of the present invention is to provide a wrench structure, wherein the direction control recess is formed with a limit portion for limiting and guiding each of the two directional blocks, so that each of the two directional blocks can be moved to a determined position exactly, thereby changing the direction of operation of the wrench handle and the drive body actually.

In accordance with the present invention, there is provided a wrench structure, comprising:

a wrench handle having a drive head formed with a receiving chamber;

the drive head having an end face formed with a direction control recess located adjacent to the receiving chamber; and the end face of the drive head being formed with a continuously arranged spacing portion located between the receiving chamber and the direction control recess.

Further benefits and advantages of the present invention will become apparent after a careful reading of the detailed description with appropriate reference to the accompanying drawings.

DETAILED DESCRIPTION OF THE INVENTION

Figure 1:
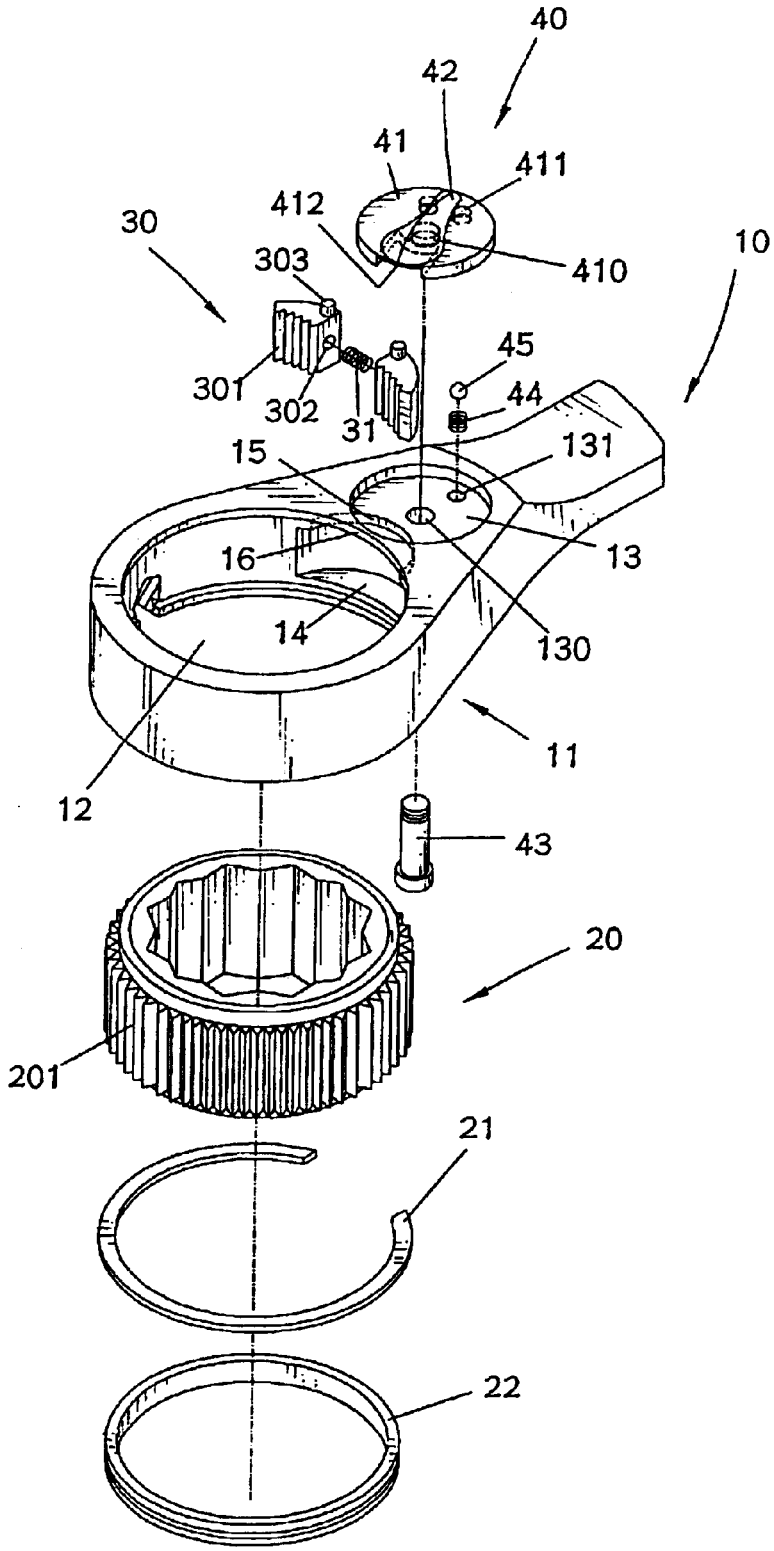
FIG. 1 is an exploded perspective view of a wrench structure in accordance with the preferred embodiment of the present invention.
Figure 2:
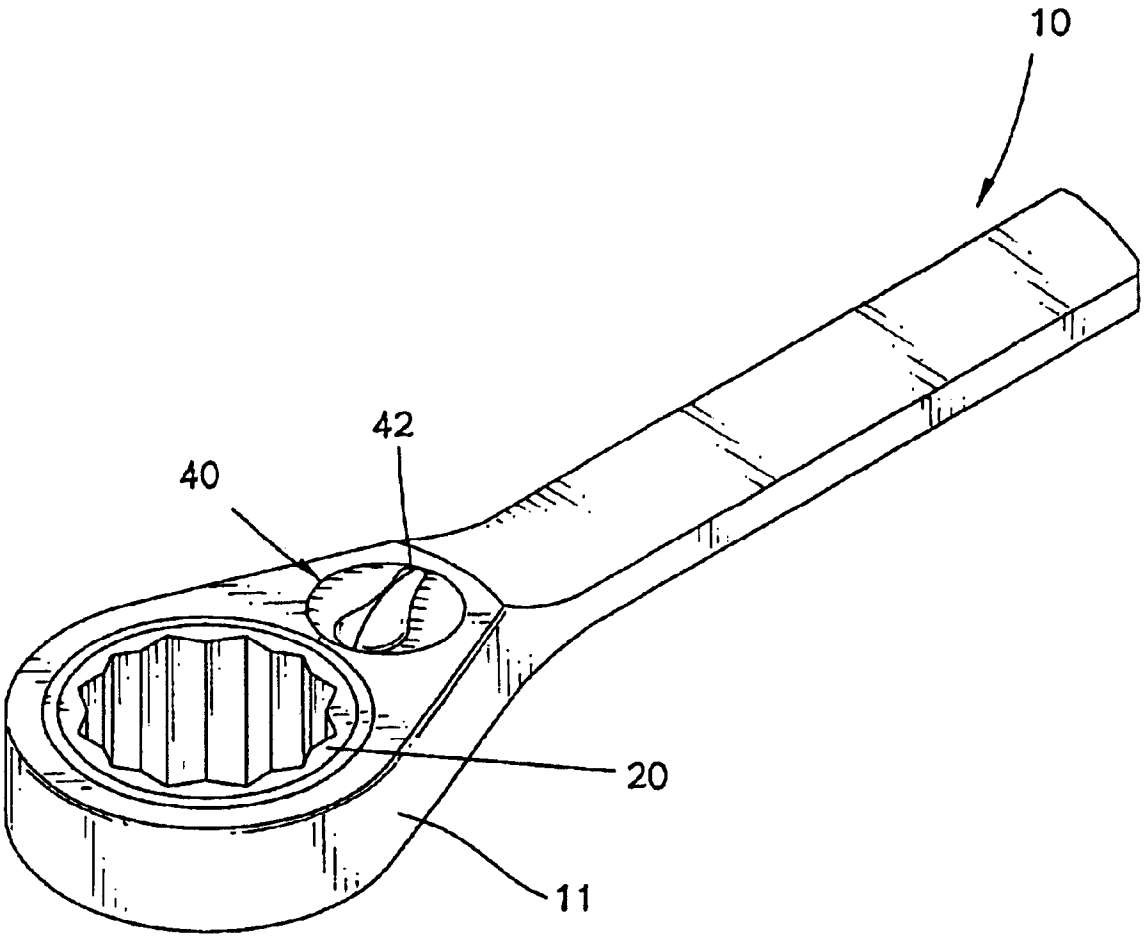
FIG. 2 is a perspective assembly view of the wrench structure in accordance with the preferred embodiment of the present invention.
Figure 3:
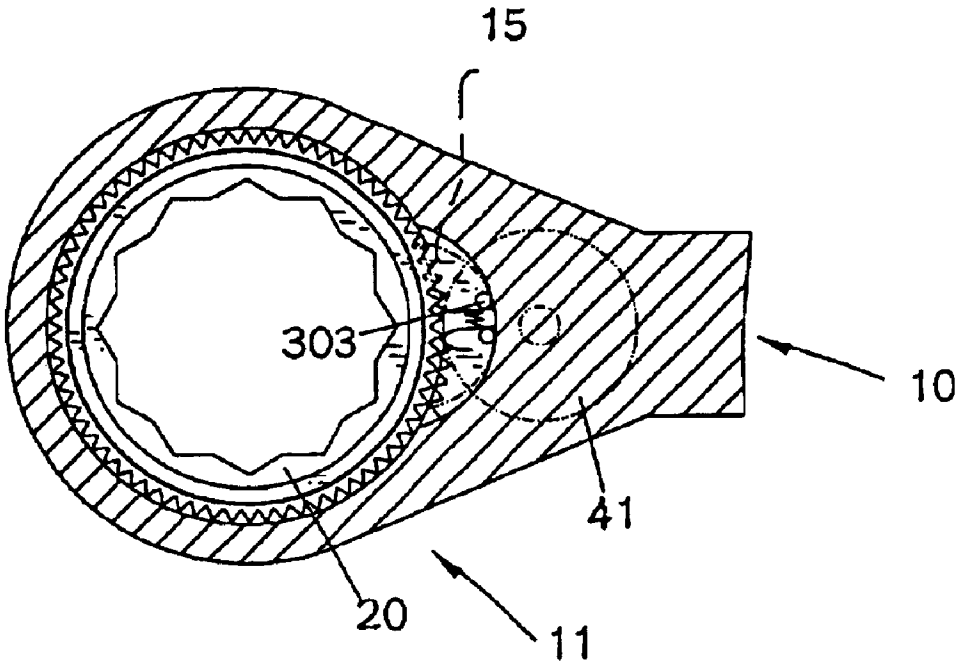
FIG. 3 is a top plan cross-sectional view of the wrench structure as shown in FIG. 2.

Referring to the drawings and initially to FIGS. 1–3, a wrench structure in accordance with the preferred embodiment of the present invention comprises a wrench handle 10, a drive body 20, two directional blocks 30, and a direction control member 40.

The wrench handle 10 has an end provided with a drive head 11. The drive head 11 is formed with a receiving chamber 12 for mounting the drive body 20. The drive head 11 has an end face formed with a direction control recess 13 located adjacent to the receiving chamber 12. The drive head 11 is formed with an arcuate guide slot 14 located between the receiving chamber 12 and the direction control recess 13.

The end face of the drive head 11 is formed with a continuously arranged spacing portion 16 located between the receiving chamber 12 and the direction control recess 13. The spacing portion 16 is continuously extended through the end face of the drive head 11 and is not broken, so that the end face of the drive head 11 is continuously extended through the drive head 11 and is not broken, thereby preventing the stress from being concentrated on the portion between the receiving chamber 12 and the direction control recess 13 of the drive head 11.

The drive body 20 is retained in the receiving chamber 12 of the drive head 11 by a C-shaped snap ring 21 and a stop ring 22. The drive body 20 has an outer wall provided with multiple ratchet teeth 201.

Each of the two directional blocks 30 is pivotally mounted in the arcuate guide slot 14 of the drive head 11, and an elastic push member 31 is mounted between the two directional blocks 30. Each of the two directional blocks 30 has an end formed with a receiving hole 302 for receiving the elastic push member 31. Each of the two directional blocks 30 has a side provided with a tooth-shaped locking portion 301 meshing with the ratchet teeth 201 of the drive body 20. Each of the two directional blocks 30 has a top face provided with a stub-shaped guide portion 303 extended into the direction control recess 13 of the drive head 11.

The direction control recess 13 of the drive head 11 has a bottom wall formed with an arcuate slotted limit portion 15 communicating with the guide slot 14 of the drive head 11, and the guide portion 303 of each of the two directional blocks 30 is extended into the limit portion 15 of the direction control recess 13.

The direction control member 40 includes a disk-shaped body 41 rotatably mounted in the direction control recess 13 of the drive head 11. The body 41 of the direction control member 40 has a top provided with a rotation handle 42 to facilitate the user rotating the body 41 of the direction control member 40. The direction control recess 13 of the drive head 11 is formed with a central hole 130. The body 41 of the direction control member 40 is formed with a fixing hole 410. The direction control member 40 further includes a fixing bolt 43 extended through the central hole 130 of the direction control recess 13 and secured in the fixing hole 410 of the body 41, so that the direction control member 40 is rotatably mounted in the direction control recess 13 of the drive head 11.

The body 41 of the direction control member 40 has a periphery formed with two spaced positioning holes 411. The direction control recess 13 of the drive head 11 has a periphery formed with a receiving hole 131 for receiving a spring-shaped elastic member 44 and a ball-shaped positioning member 45. The positioning member 45 is pushed by the elastic member 44 and is locked in either one of the two spaced positioning holes 411 of the body 41, so that the direction control member 40 can be positioned at two different positions. The body 41 of the direction control member 40 is formed with two guide tracks 412 each rested on the guide portion 303 of a respective one of the two directional blocks 30.

Figure 5:
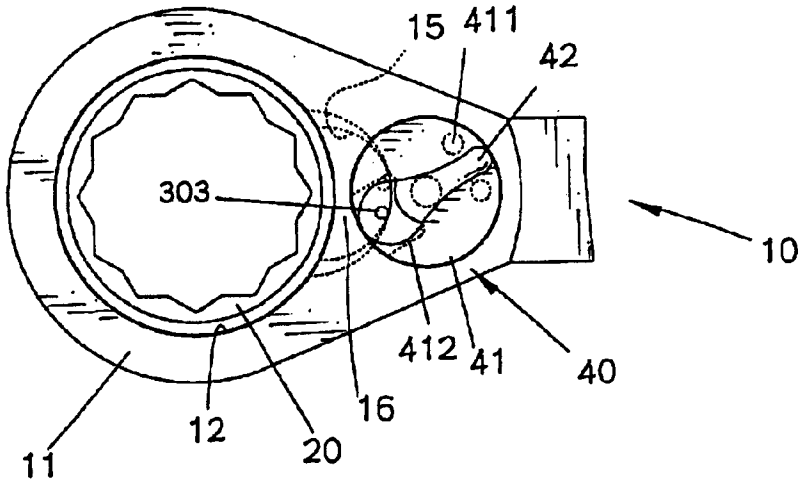
FIG. 5 is a top plan operational view of the wrench structure as shown in FIG. 2.
Figure 4:
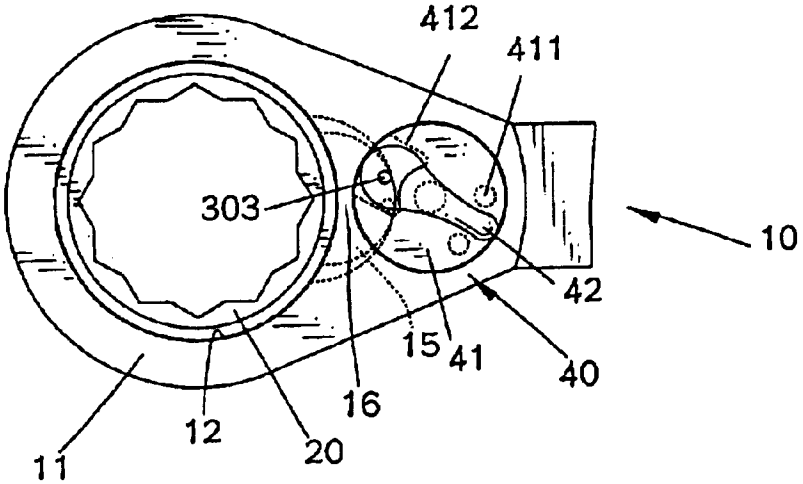
FIG. 4 is a top plan operational view of the wrench structure as shown in FIG. 2.

In operation, as shown in FIGS. 4 and 5, when the body 41 of the direction control member 40 is rotated, each of the guide tracks 412 is deflected and moved. Thus, the guide portion 303 of one of the two directional blocks 30 is moved by the respective guide track 412 of the body 41, so that the one directional block 30 can be pivoted and deflected toward one side of the guide slot 14 of the drive head 11, with the locking portion 301 of the one directional block 30 meshing with the ratchet teeth 201 of the drive body 20. In such a manner, when the drive head 11 of the wrench handle 10 is rotated, the drive body 20 is driven by one of the two directional blocks 30 to rotate in a single direction.

Accordingly, the wrench structure in accordance with the present invention has the following advantages.

1. The end face of the drive head 11 is formed with a spacing portion 16 located between the receiving chamber 12 and the direction control recess 13. The spacing portion 16 is continuously extended through the end face of the drive head 11 and is not broken, so that the end face of the drive head 11 is continuously extended through the drive head 11 and is not broken, thereby preventing the stress from being concentrated on the portion between the receiving chamber 12 and the direction control recess 13 of the drive head 11, such that the structural strength of the drive head 11 can be enhanced so as to increase the lifetime of the wrench structure.

2. Each of the two directional blocks 30 is guided by the arcuate guide slot 14 of the drive head 11, while the guide portion 303 of each of the two directional blocks 30 is limited by the limit portion 15 of the direction control recess 13 and is guided by the respective guide track 412 of the body 41, so that movement of each of the two directional blocks 30 is limited exactly, and each of the two directional blocks 30 can be moved in the arcuate guide slot 14 of the drive head 11 rigidly and stably and will not be deflected toward the drive body 20. Thus, each of the two directional blocks 30 can be engaged with the drive body 20 exactly, so that the drive body 20 can be operated rigidly and stably.

Figure 6:
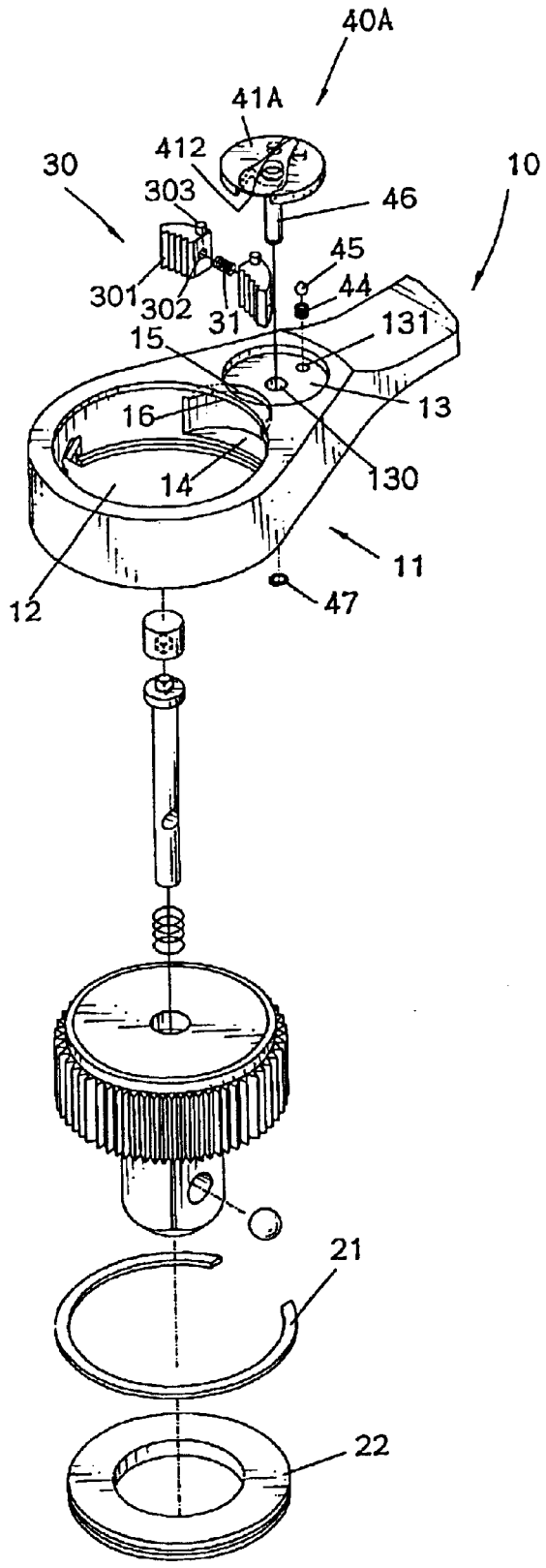
FIG. 6 is an exploded perspective view of the wrench structure in accordance with another embodiment of the present invention.

Referring to FIG. 6, the wrench structure in accordance with another embodiment of the present invention is shown, wherein the body 41A of the direction control member 40A has a bottom provided with a protruding pivot shaft 46 extended through the central hole 130 of the direction control recess 13, and the direction control member 40A further includes a retaining member 47 secured on a lower end of the pivot shaft 46 and rested on a bottom the drive head 11, thereby retaining the direction control member 40A on the drive head 11.

Figure 7:
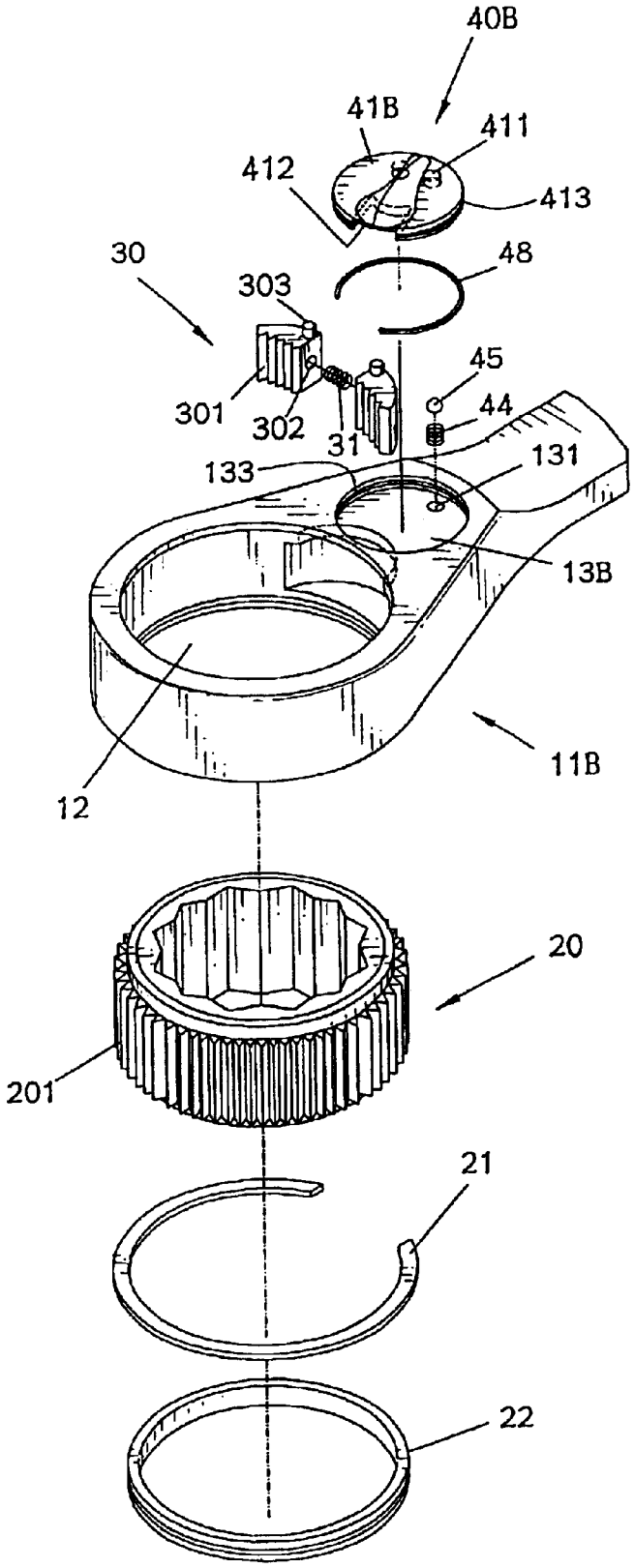
FIG. 7 is an exploded perspective view of the wrench structure in accordance with another embodiment of the present invention.

Referring to FIG. 7, the wrench structure in accordance with another embodiment of the present invention is shown, wherein the body 41B of the direction control member 40B has an outer wall formed with an annular groove 413, the direction control recess 13B has a wall formed with an annular groove 133, and the direction control member 40B further includes a C-shaped retaining member 48 secured in the annular groove 413 of the body 41B and the annular groove 133 of the direction control recess 13B, thereby retaining the direction control member 40B on the drive head 11B.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A wrench structure comprising:

a wrench handle having a drive head formed with a receiving chamber;

the drive head having an end face formed with a direction control recess located adjacent to the receiving chamber;

the end face of the drive head being formed with a continuously arranged spacing portion located between the receiving chamber and the direction control recess, the drive head being formed with an arcuate guide slot located between the receiving chamber and the direction control recess;

two directional blocks each pivotally mounted in the arcuate guide slot of the drive head, each of the two directional blocks having a top face provided with a stub-shaped guide portion extended into the direction control recess of the drive head;

a direction control member including a disk-shaped body rotatably mounted in the direction control recess of the drive head, wherein the body of the direction control member is formed with two guide tracks each rested on the guide portion of a respective one of the two directional blocks;

the body of the direction control member having an outer wall formed with an annular groove, the direction control recess having a wall formed with an annular groove, and the direction control member further including a retaining member secured in the annular groove of the body and the annular groove of the direction control recess, thereby retaining the direction control member on the drive head.

* * * * *